US006593953B1

(12) United States Patent
Ross et al.

(10) Patent No.: US 6,593,953 B1
(45) Date of Patent: Jul. 15, 2003

(54) DUAL INK JET PRINT CARRIAGE FOR WEB PRINTING

(75) Inventors: George C. Ross, Philomath; Lawrence R. Plotkin, Corvallis, both of OR (US); Paul R. Krouss, Barcelona (ES); David M. Kwasny, Corvallis, OR (US); Craig A. Wright, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/655,179

(22) Filed: Sep. 5, 2000

(51) Int. Cl.[7] ..... B41J 15/10; B41J 3/54
(52) U.S. Cl. ..... 347/221; 400/82; 400/159
(58) Field of Search ..... 347/43, 42, 15, 347/37, 12, 221; 400/82, 605, 57, 58, 59, 124.08, 158.1, 159; 399/95, 278, 229, 387, 389

(56) References Cited

U.S. PATENT DOCUMENTS 5,301,611 A 4/1994 Derivi
5,371,531 A 12/1994 Rezanka et al.
5,428,375 A * 6/1995 Simon et al. ..... 347/12
5,611,629 A 3/1997 Paranjpe
5,677,719 A * 10/1997 Granzow ..... 347/103
5,683,187 A 11/1997 Tunmore
5,784,077 A 7/1998 Silverbrook ..... 347/2
6,280,106 B1 * 8/2001 Juan et al. ..... 400/605

FOREIGN PATENT DOCUMENTS

EP 813971 A2 12/1997
EP 835761 A2 4/1998
JP 9-174968 7/1997

OTHER PUBLICATIONS

EPO Search Report from related case 01307457.0–1251 dated Apr. 19, 2002.

* cited by examiner

*Primary Examiner*—Lamson Nguyen

(57) ABSTRACT

Throughput of ink jet printers can be increased by using multiple print heads, each of which independently prints an image or text on a continuous roll of print media. Independently controlled printer carriages supporting the print heads simultaneously print images onto media since the printer carriages are separated by a distance that is substantially to equal to at least one dimension of the image to be printed.

4 Claims, 4 Drawing Sheets

M = MAXIMUM LENGTH POSSIBLE OF MEDIA FROM CARRIAGE 1 TO CARRIAGE 2

DUAL INK JET PRINT CARRIAGE FOR WEB PRINTING

FIELD OF THE INVENTION

This invention relates to a printing apparatus. In particular, this invention relates to a novel design for a high speed web ink jet printing method and apparatus using multiple print heads to simultaneously print images on a roll of print media.

BACKGROUND OF THE INVENTION

Thermal ink jet printers are well known and nearly ubiquitous among consumers who purchase and use personal computers in their home. More recently, improvements in thermal ink jet printing technology and improvements in the paper media used by these printers have yielded significant gains in image quality such that this technology is now used to print photo-quality images. It is anticipated that this technology will find use in commercial printing.

One drawback of a thermal ink jet printer, as well as piezo-electric electric ink jet printers, is the speed at which these machines are capable of producing images. At present, a single image is painted on the print media by a print head or group of printheads in a carriage assembly that repeatedly passes over or sweeps over the media, painting a line of multi-colored dots each time the printer carriage traverses the media surface. In such an operation, printing an image requires a significant amount of time. In an application where numerous images must be printed in a short time, such as in commercial printing, a single print head simply requires too much time to quickly print hundreds or even thousands of images a day.

A method and apparatus by which the throughput of an ink jet printer could be increased, particularly in commercial printing would be an improvement over the prior art.

SUMMARY OF THE INVENTION

A printer comprised of a paper delivery mechanism that moves paper beneath two or more ink jet printer carriages significantly increases the output rate of a thermal ink jet printer if multiple carriages are used to print several discrete images on a print media simultaneously. One printer carriage prints a first image on a first area of a print media while a second printer carriage prints a second image in a second area on the media while the first printer carriage prints the first image.

DETAILED DESCRIPTION OF THE PREFERRED EMBODIMENT

Figure 1:
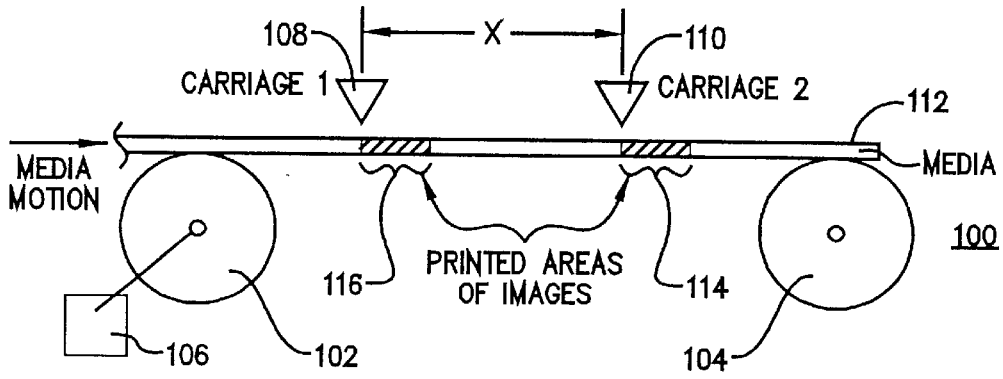
FIG. 1 shows a simplified diagram of a two-carriage printer side view showing the relative positions of two printer carriages printing different images on the same side but in different areas of a print media that is controlled by the printer's paper delivery mechanism.

FIG. 1 shows a simplified block diagram of an exemplary side view of a high speed web ink jet printer 100. The printer 100 includes at least two printer rollers or platens 102 and 104, at least one of which is driven by an appropriate motor or drive mechanism 106. Alternate embodiments would include driving both platens 102 and 104. The drive mechanism 106 acts to rotate the at least one roller or platen, which can be considered a mechanism for delivering print media, such that paper, transparency film, or other print media 112 is precisely positioned below at least two printer carriages 108 and 110. In a preferred embodiment, these carriages provide mechanical support and orientation as well as electrical interconnection for ink ejecting devices, which can be ink containing ink cartridges with integral print heads or print heads with off-board ink containment.

Rotation of at least one of the platens or rollers 102 and 104 moves the print media 112 relative to the print carriages 108 and 110 such that as the print carriages 108 and 110 move in a direction perpendicular to the direction of print media movement across the print media (i.e. into and out of the plane of FIG. 1), at least one line of an image to be printed onto the media 112 is formed by ink drop ejection from a printhead. (Typically, a flat surface platen is provided beneath a print carriage containing an inkejecting print cartridge, but a roller surface parallel to the axis of rotation may also be used as a platen). As the paper or media 112 is repositioned under the print carriages 108 and 110 by moving laterally (i.e. across the plane of FIG. 1) successive lines or portions of an image 114 or 116 are printed by successive passes of the print carriages 108 and 110 over the media 112. As shown in FIG. 1, the print carriages 108 and 110 print on the same side of the media 112 and in the preferred embodiment, the two print carriages are capable of printing separate images, simultaneously. However, in an alternative embodiment. printing is accomplished on opposite sides of the medium.

In printing either text, pictures or other images, print carriages 108 and 110 are capable of printing black as well as several color inks onto the media 112. While the preferred embodiment contemplates thermal ink jet print heads, at least one alternate embodiment would include other piezo electric print apparatus as well as other print carriages that might use dry inks or even laser toner inks.

By individually controlling the print carriages 108 and 110, text, pictures or other images can be printed onto different areas of the print media 112 simultaneously. Being able to simultaneously and continuously print multiple text or image sections significantly increases printer throughput.

In one embodiment, a single controller, i.e. computer, microprocessor, microcontroller ASIC, or FPGA, controls multiple carriages with single or multiple print heads. Other embodiments would include using multiple, dedicated controllers, each controlling a single carriage, on a per-print basis. Similarly, a single motor might be used to move multiple carriages. While the print heads of the first carriage 108 are printing one image, the printheads of the second carriage 110 can be printing yet another image. Alternatively, the two carriages can operate independently or they can be mechanically linked such that all motion is synchronized. The distance between the leading or initial edges of the two images printed from the two different carriages is specified or shown in FIG. 1 to be a predetermined distance 118. In practice, where paper or media waste is to minimized. one dimension of an image to be printed by the first carriage 108 would be less than or equal to an integral multiple of the distance X separating the two carriages 108 and 110, ($P \leqq {}^{X}/n$) where n is an integer.

Figure 2:
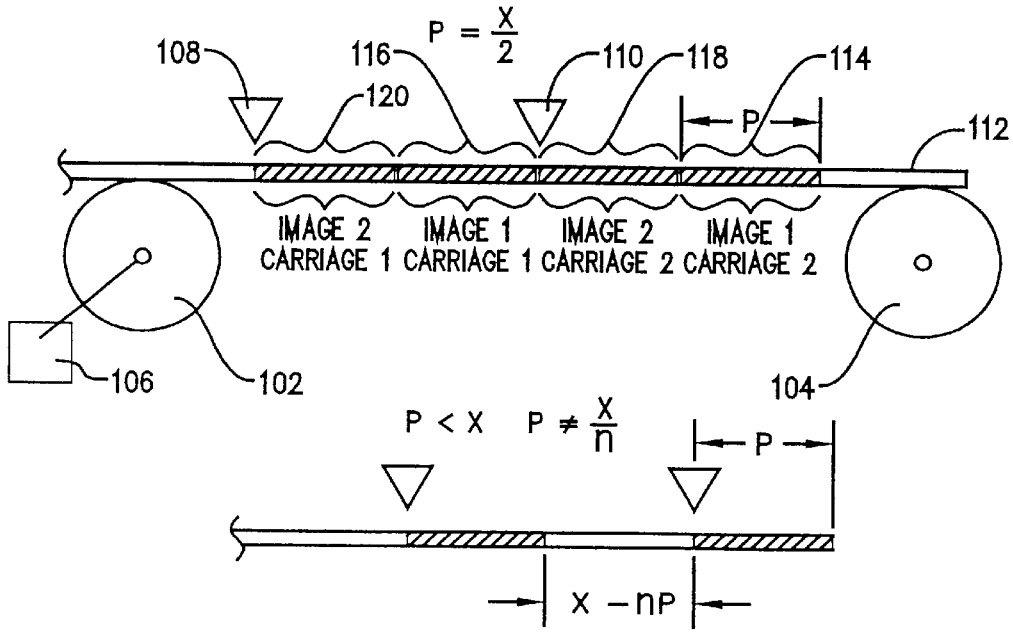
FIG. 2 shows a simplified diagram of the side view of the printer of FIG. 1 after different images have been printed on the media by the different print heads.

FIG. 2 shows the printer mechanism of FIG. 1 after a series of images, 114, 116, 118 and 120 were printed substantially simultaneously, on the same side of the print media 112 by the print heads of the two carriages 108 and 110 which are spaced apart from each other by a distance "X" as shown in FIG. 1. In FIG. 2, the motor or drive mechanism 106 has already caused one or both of the rollers or platens 102 and 104 to rotate, causing the print media 112 to traverse a first distance "2P", where P is the length of a single image, during which traversal a series of four different images is printed by the print heads of the two different carriages. In the first distance "P" two images 114 and 116 were printed on the same side of the media 112. In the second distance X-P, two other images 118 and 120 can be printed, if the distance "2P" is less than or at least equal to the spacing X between the two carriages 108 and 110 ($2P \leqq X$).

It is also possible to print images larger than X when ($P>X$) with the system, albeit with speed loss. If for instance the carriage spacing X is six inches (15.2 cm) but the image or images to be printed are larger, say eight inches (20.3 cm) in length, two inches (5 cm) of a first image 114 is printed by carriage 110 before the other carriage starts printing. As printing progresses and media is moved along under carriage 110, the other carriage 108 will start printing a second eight-inch (20.3 cm) image after the media had moved at least two inches (5 cm) of the first image being printed by carriage 110. When the first image 114 is finished, the second image continues printing under the other carriage 108 for its final two inches (5 cm).

With respect to FIG. 2, a first image 114 printed from the print carriage 110 is directly adjacent to a second print image 118 that was also printed from the first carriage 110. The length or dimension of the two images 114 and 118 is preferably identical to or less than the distance 118 separating the two carriages 108 and 110 ($P \leqq {}^{X}/n$). As shown, the space between these two carriages provides sufficient space in which two other images 116 and 120 were printed by the second print carriage 108 while the first carriage 110 printed images 114 and 118. If $P={}^{X}/n$, there is essentially no waste media created once all four images are complete. The media can be indexed forward the X distance, and both carriages can begin the printing process again. If $P \neq {}^{X}/n$, there is some waste media ($X-nP$), which is smaller than P and which is not printed upon. When the media is indexed forward to begin printing, this portion of the media is waste. Stated alternatively, using two print carriages, reduces by a factor of 2, the amount of time required to print any even number of images on a single media.

Figure 3:
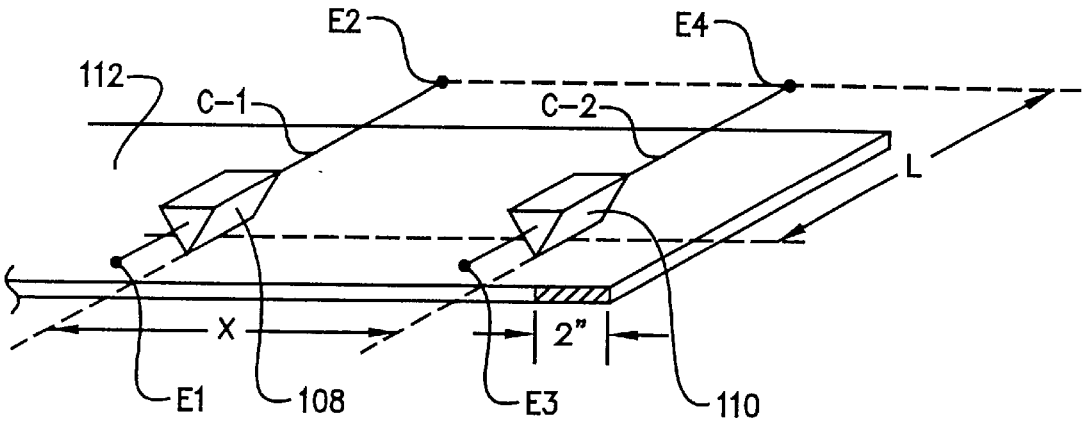
FIG. 3 shows an isometric view of the placement of two printer carriages in a multi-carriage printer whereby different images can be printed simultaneously using different carriages printing onto different sections of a print media.

FIG. 3 shows a simplified prospective view of a two-carriage printer mechanism. In FIG. 3 it can be seen that the two print carriages 108 and 110 travel along line segments between end points of these line segments. The first print carriage 108 travels along a chord C1 having end points E1 and E2. Similarly the second print carriage 110 travels along a different chord C2 having end points E3 and E4 respectively. The distance separating these two chords is shown in FIG. 3 to be, for example, the distance "X."

In the course of printing images, the print heads 108 and 110 will traverse the print media 112 along the parallel chords C1 and C2, both of which are shown in FIG. 3 as having an equal length, "L."

Printing an image requires that the carriages 108 and 110 perpendicularly traverse the print media 112 as it is moved along underneath the print carriages by the rollers or platens not shown in FIG. 3.

In the preferred embodiment, the printer heads 108 and 110 are co-planar, i.e. lie in a same plane such that the media 112 is substantially planer as the print carriages are painting the successive lines of the images beneath them. Alternate embodiments would of course include having the printer carriages 108 and 110 non-co-planer printing the successive images on different areas of the print media 112 as it rests on one or more roller or platen mechanisms.

The embodiments shown in FIGS. 1, 2, and 3 all depict fixed-position printer carriages (over which the printer cartridges move). A limitation of such an embodiment is that the spacing between the printer carriages being fixed, limits the image size that can be printed efficiently between the two carriages 108 and 110.

By varying the distance between the two printer carriages 108 and 110, it is possible that the image sizes being printed by their respective carriages be made variable while minimizing waste. In other words, it might be possible to have the cartridges on one printer carriage 110 print a 4"×6" image while printer cartridges on a second carriage 108 prints an 8"×10" image if the spacing between the printer heads or printer carriages is adjusted to allow an 8" separation between the printer carriages.

Figure 4:
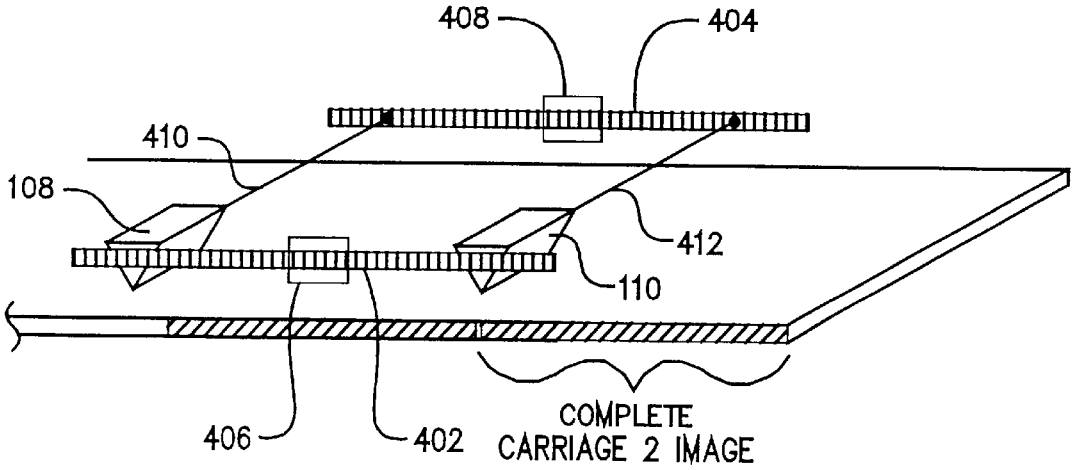
FIG. 4 shows at least one alternate embodiment of a multi-carriage printer the carriages of ,which are moveable with respect to each other so as to adjust or vary the size of the images that are printed from the respective print heads.

FIG. 4 shows the printer carriages 108 and 110 mounted or coupled to screw-drive rotating threaded shaft, not unlike those routinely found in floppy and hard disk drives as well as CD-ROM drives by which precision positioning of the printer carriage heads 108 and 110 can be accomplished by rotating the threaded shafts 402 and 404 some predetermined number of revolutions under the control of a suitable drive mechanism 406 and 408. As the shafts 402 and 404 are rotated, matching threaded couplers are fixed to the printer carriages 108 and 110 will cause the printer carriages, and any associated mounting shafts 410 and 412 to cause the distance between the printer carriages 108 and 110 to increase or decrease, depending upon the direction of the threaded shaft rotation and the number of turns. In the embodiment, the separation distance X is not a constant value.

By having a variable spacing between the printer carriages, it is possible to print variable size images between the printer carriages depending upon the spacing between them. A media cutter, such as that offered by Lucht Engineering, Inc. of Bloomington Minn. as an "automatic package cutter" and integrated into the media flow, can be employed to separate the images into properly sized sheets.

Figure 5:
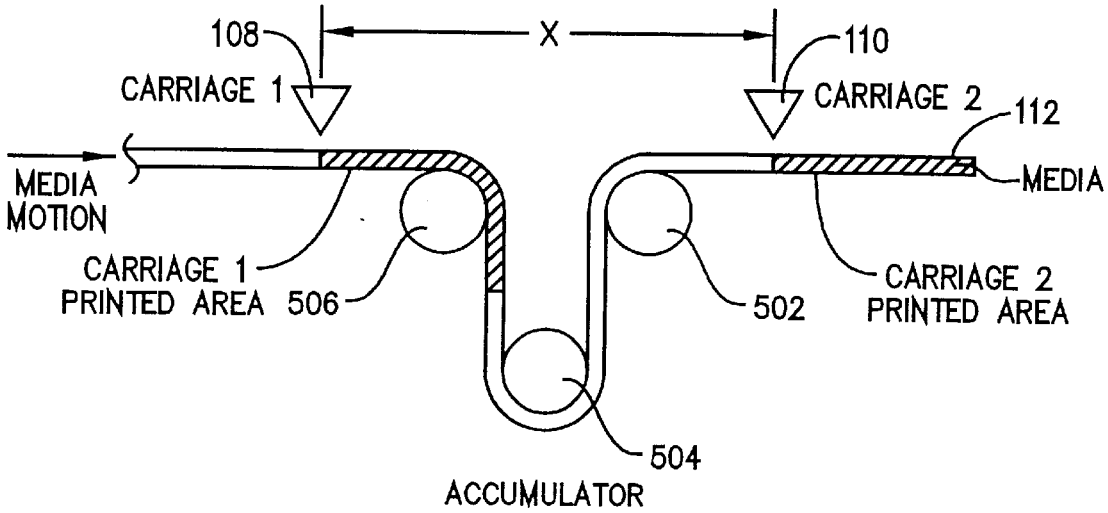
FIG. 5 shows another alternative embodiment of a multi-carriage printer that employs a plurality of roller mechanisms known as an accumulator, for increasing amount of media between the two fixed position carriages.

Yet another embodiment is shown in FIG. 5 wherein a series of moveable platens or rollers 502, 504 and 506 comprise an accumulator by which additional paper or print media 112 can be rolled between the two printer cartridges 108 and 110 as printing operations proceed. As shown in FIG. 5, depending upon the spacing between the platens 502, 504 and 506, the amount of paper stored between the two carriages 108 and 110 can be varied in order to change the size of the image that can be printed between the two carriages.

Figure 6:
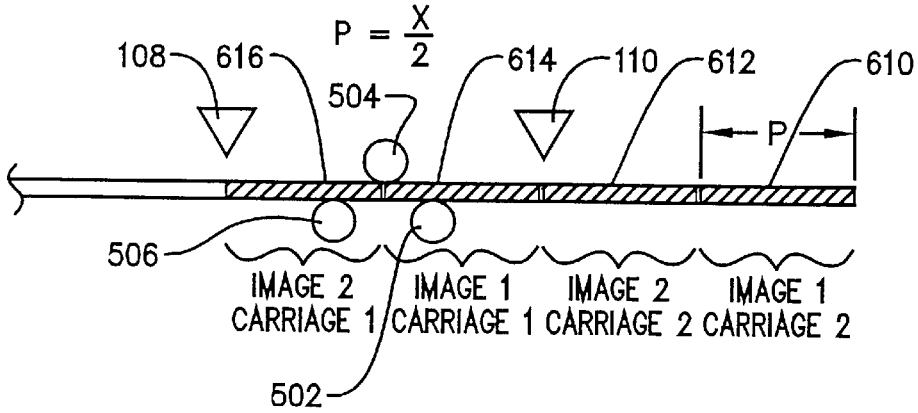
FIG. 6 shows the alternative embodiment of FIG. 5 with the rollers or platens of FIG. 5 in a position where the media between the two fixed position carriages is minimized.

In FIG. 6, there is shown the three platens 502, 504 and 506 in positions that minimize the accumulation of print media between the carriages 108 and 110. In this figure, four images 610, 612, 614 and 616 were printed from the two printer carriages 108 and 110 each image of which has a fixed width designated by reference character "P." Thus $P={}^{X}/2$, where n=2.

By varying the distance between the rollers or platens 502, 504 and 506 it is possible to change the maximum image height or width printed by the print carriage 108 with respect to 110.

Figure 7:
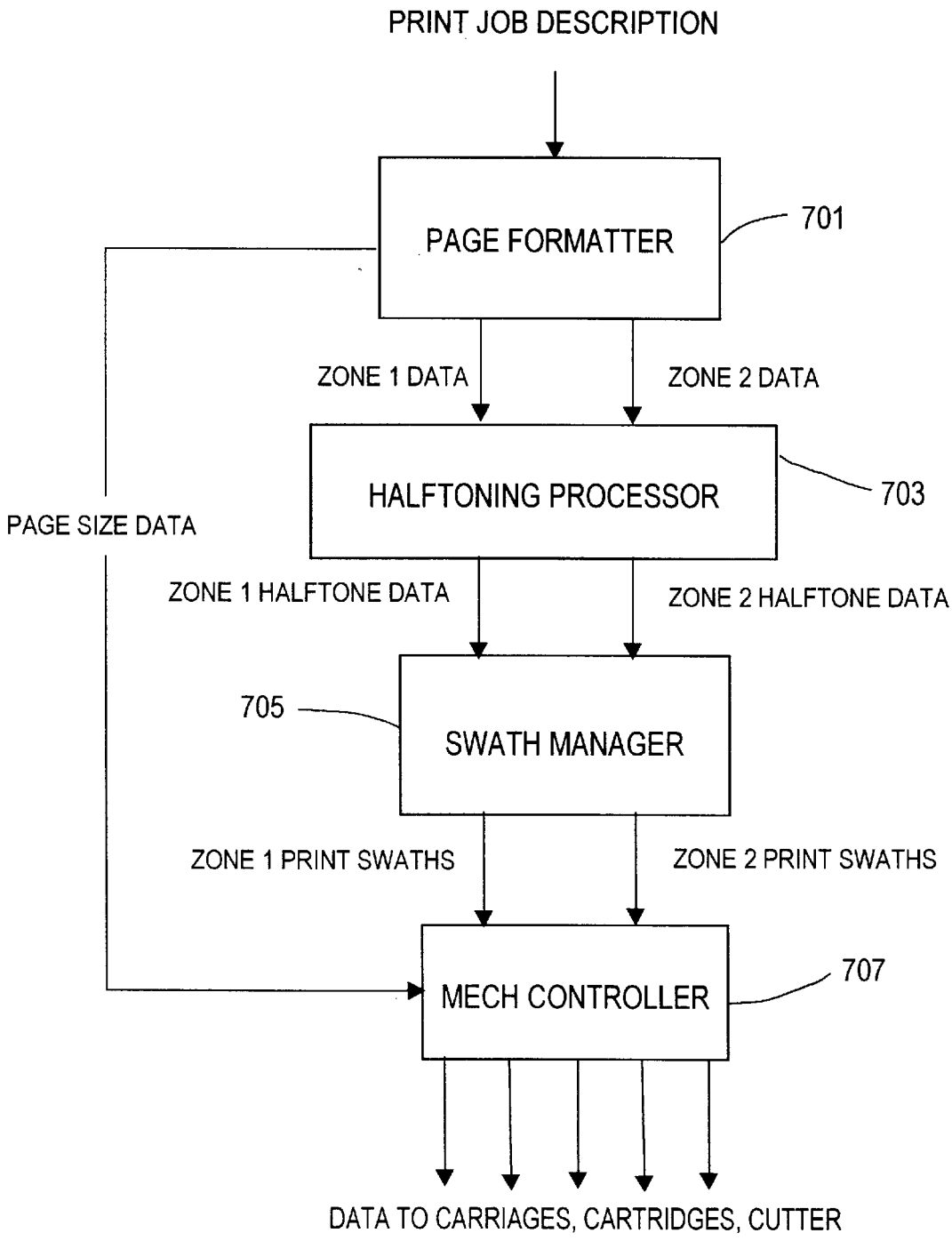
FIG. 7 is a high level control system flowchart which may be employed in the present invention.

A preferred embodiment control system for the high speed web printer 100 is shown in the block diagram of FIG. 7. A print job description, for example, a description defining image data as 24-bit RGB, specifying the number of copies, image sizing information, and quality and medium settings, is input to the page formatter 701. The page formatter determines the page sizes and partitions the print job for two print zones. A halftoning processor 703 accepts the two print zone input and alternately halftones image bands for the print zones defined for carriages 1 and 2. A swath manager 705 applies the appropriate print mode and formats halftoned image bands into print swaths. The two zone output from the swath manager 705 and page size information from the page formatter 701 is applied to a mechanism controller 707 so that the print accumulator can be set, the platen driving motors are properly energized, and swath data is coupled to the printheads of carriage 1 and carriage 2, and the medium cutting mechanism is activated at the end of the image printing cycle.

While two printer carriages are shown in the figures above, those skilled in the art will recognize that three or more printer carriages might be used to print images simultaneously on the same print media. By increasing the number of print carriages that operate on a section of print media, the number of images being printed at any given time can be increased proportionately. By individually controlling the operation of the printer carriages, it is possible to print high quality color images using thermal ink jet or even piezoelectric technology to print multiple images at substantially the same time increasing significantly the throughput of a thermal ink jet printer. When used in commercial printing systems for example, dual printer carriages could significantly increase the output required in high volume print processing systems.

We claim:

1. A printer comprising:

a mechanism delivering in a feed direction a substantially continuous print media on which a plurality of images can be printed onto said media;

a first printer carriage capable of printing a first image on a first area of said print media;

a second printer carriage, capable of printing a second image on a second area of said print media while said first printer carriage prints at least a portion of said first image, the second image spaced apart on the print media along the feed direction;

an accumulator mechanism between said first and second printer carriages over which print media is rolled, the accumulator mechanism variable to adjust the spacing apart of the first and second images along the feed direction.

2. The printer of claim 1 wherein said accumulator is comprised of a plurality of roller mechanisms for accumulating a quantity of media.

3. The printer of claim 1 wherein said accumulator is comprised of a plurality of moveable roller mechanism for accumulating a variable amount of media between said first and second printer carriages.

4. A method of simultaneously printing multiple images onto a print media, the print media delivered in a feed direction, comprising the steps of:

spacing apart along the print media in the feed direction a first printer cartridge and a second printer cartridge;

adjustably accumulating a length of print media between the first and second print cartridges;

printing a first image on a first side of said print media at a first location using the first printer cartridge;

while said first image is printed, printing a second image on said first side of said print media at a second location using the second print cartridge.

* * * * *